US010199760B2

(12) United States Patent
Park et al.

(10) Patent No.: US 10,199,760 B2
(45) Date of Patent: Feb. 5, 2019

(54) ELECTRONIC DEVICE INCLUDING BIDIRECTIONAL CONNECTOR

(71) Applicant: Samsung Electronics Co., Ltd., Gyeonggi-do (KR)

(72) Inventors: Chungsoon Park, Gyeonggi-do (KR); Junghyun Kang, Gyeonggi-do (KR); Hyunmin Seo, Seoul (KR); Seung-Ho Lee, Seoul (KR); So-Young Lee, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 105 days.

(21) Appl. No.: 15/272,560

(22) Filed: Sep. 22, 2016

(65) Prior Publication Data

US 2017/0149158 A1 May 25, 2017

(30) Foreign Application Priority Data

Nov. 19, 2015 (KR) ..... 10-2015-0162460

(51) Int. Cl.

| | |
|---|---|
| ***H01R 12/00*** | (2006.01) |
| ***H01R 13/24*** | (2006.01) |
| *H01R 12/70* | (2011.01) |
| *H01R 13/18* | (2006.01) |

(52) U.S. Cl.

CPC ..... *H01R 13/2421* (2013.01); *H01R 12/7082* (2013.01); *H01R 13/18* (2013.01)

(58) Field of Classification Search

CPC ..... H01R 13/2421

USPC ..... 439/75, 66, 700

See application file for complete search history.

(56) References Cited

U.S. PATENT DOCUMENTS

| | | | | |
|---|---|---|---|---|
| 2,977,562 | A * | 3/1961 | Benson | H01R 33/7671 228/180.1 |
| 3,267,334 | A * | 8/1966 | Wulc | H05K 7/023 361/729 |
| 3,663,931 | A * | 5/1972 | Brown | H01R 12/58 439/70 |
| 3,941,442 | A * | 3/1976 | Friend | H05K 3/368 439/862 |

(Continued)

FOREIGN PATENT DOCUMENTS

KR 10-2007-0067562 A 6/2007

*Primary Examiner* — Neil Abrams

(74) *Attorney, Agent, or Firm* — Cha & Reiter, LLC

(57) ABSTRACT

An electronic device may include a substrate including a first surface facing a first direction, and a second surface facing a second direction, the second direction being opposite to the first direction; a first connector arranged on the first surface, wherein the first connector includes a first hollow member extending in the first direction; a first movable conductive member inserted in the first hollow member and movable in the first direction; and a first elastic member for supporting the first movable conductive member; a second connector arranged on the second surface and aligned with the first connector in the first direction, wherein the second connector includes a second hollow member extending in the first direction, a second movable conductive member inserted into the second hollow member and movable in the first direction, and a second elastic member for supporting the second movable conductive member.

18 Claims, 13 Drawing Sheets

(56) References Cited

U.S. PATENT DOCUMENTS 4,482,937 A * 11/1984 Berg ..... H01R 12/73 361/789
4,514,784 A * 4/1985 Williams ..... H01R 12/52 361/716
4,867,691 A * 9/1989 Eck ..... H01R 12/58 29/843
4,909,746 A * 3/1990 Scholz ..... H01R 12/523 439/74
5,040,993 A * 8/1991 Krug ..... G06F 13/409 439/75
5,059,130 A * 10/1991 Miller, Jr. ..... H01R 12/523 439/74
5,641,291 A * 6/1997 Sueki ..... H01R 12/57 439/74
5,653,615 A * 8/1997 Inaba ..... H01R 13/17 439/827
6,276,945 B1 * 8/2001 Hayward ..... H01R 13/6588 439/82
6,503,090 B2 * 1/2003 Onizuka ..... H01R 12/58 439/75
6,524,117 B1 * 2/2003 Murakami ..... H01R 13/193 439/74
7,008,242 B2 * 3/2006 Inoue ..... H01R 4/643 439/268
7,740,488 B2 * 6/2010 Taylor ..... H01R 12/714 439/66
8,446,733 B2 * 5/2013 Hampo ..... H05K 1/144 361/775
8,545,237 B2 * 10/2013 Johnson ..... H01R 12/523 439/75
9,054,450 B2 * 6/2015 Nagasaki ..... H01R 12/585
9,196,981 B2 * 11/2015 Shimoji ..... H01R 12/7076
2007/0105409 A1 * 5/2007 Brekosky ..... H01R 12/585 439/75
2017/0149158 A1 * 5/2017 Park ..... H01R 13/2421

* cited by examiner

ELECTRONIC DEVICE INCLUDING BIDIRECTIONAL CONNECTOR

CLAIM OF PRIORITY

This application claims the priority under 35 U.S.C. § 119(a) to Korean Application Serial No. 10-2015-0162460, which was filed in the Korean Intellectual Property Office on Nov. 19, 2015, the entire contents of which are hereby incorporated by reference.

TECHNICAL FIELD

The present disclosure generally relates to an electronic device including a connection connector.

BACKGROUND

An electronic device, such as a smartphone, may be called an electronic communication device that provides multimedia functionality, such as, for example, storing of various kinds of information, playing a game, and watching a video by a communication function such as a voice call and transmission of a message while being carried by a user. The electronic device may include a plurality of connection terminals include connection terminals connecting various components, and may also, be configured to be electrically connected to various external devices. For example, from among various connection terminals, terminals for connection between an electronic component and a component or terminals for connection between the electronic device and the external device can be used.

Meanwhile, from among the connection terminals used in the electronic device, a connector such as a pogo pin has been widely used according to the stability of a connection state. The pogo pin can be mounted for charging of the device or data communication.

However, as the number of pogo pins mounted to the electronic device increases, a space for installing the pogo pins may become more limited.

Various embodiments of the present disclosure can increase an electrical efficiency according to a decrease in the size of a substrate and sharing of a connector pattern by use of an opposite region to a Printed Circuit Board (PCB) to which a unidirectional connector is mounted.

SUMMARY

An electronic device according to various embodiments of the present disclosure may include: a substrate including a first surface facing a first direction and a second surface facing a second direction, the first direction being opposite to the second direction. A first connector may be arranged on a first surface. The first connector may include a first hollow member extending in the first direction, a first movable conductive member that is inserted into the first hollow member and is movable in the first direction, and a first elastic member for supporting the first movable conductive member, the first connector being arranged on the first surface. A second connector may include a second hollow member extending in the first direction, a second movable conductive member that is inserted into the second hollow member and is movable in the first direction, and a second elastic member for supporting the second movable conductive member, the second connector being arranged on the second surface and aligned with the first connector in the first direction; and at least one electrical path formed on or inside the substrate. The at least one electrical path may provide an electrical connection to at least one of the first movable conductive member and the second movable conductive member.

An electronic device according to various embodiments of the present disclosure may include: a substrate including a first surface facing a first direction and a second surface facing a second direction opposite to the first direction; a plurality of first connectors including a first hollow member extending in the first direction, a first movable conductive member that is inserted in to the first hollow member and is movable in the first direction, and a first elastic member for supporting the first movable conductive member, the first connectors being located and aligned on the first surface; a plurality of second connectors including a second hollow member extending in the first direction; a second movable conductive member that is inserted into the second hollow member and is movable in the first direction, and a second elastic member for supporting the second movable conductive member, at least one second connector being aligned with at least one first connector in the first direction, the second connectors being located and aligned on the second surface; and a plurality of paths including at least one path formed on or inside the substrate. The plurality of paths provides an electrical connection to at least one first movable conductive member and/or at least one second movable conductive member.

An electronic device according to various embodiments of the present disclosure may include a substrate including a first surface and a second surface opposite to the first surface; at least one first connector arranged on the first surface to elastically support the first conductive member; at least one second connector that is arranged on the second surface to elastically support a second conductive member, which may be replaced with the first connector; and at least one connection member arranged on the first surface, to which at least a part of the second connector is connected. An electrical connection path can be provided between the first and second conductive members using a connection member.

An electronic device according to various embodiments of the present disclosure may include: a substrate including a first surface and a second surface opposite to the first surface; a first connector array configured by aligning and arranging, on the first surface, a plurality of first connectors arranged to elastically support a first conductive member; a second connector array, which may be replaced with the first connector array, and may be configured by aligning and arranging, on the second surface, a plurality of second connectors arranged to elastically support a second conductive member; and a plurality of connection members which are arranged on the first surface, are press-fitted to at least some of the first connectors, respectively, and are connected to at least some of the second connectors, respectively. One or more electronic connection paths can be provided between the first and second connectors using connection members, respectively.

The above and other aspects of the present disclosure are more fully described hereinbelow in the detailed description that follows.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
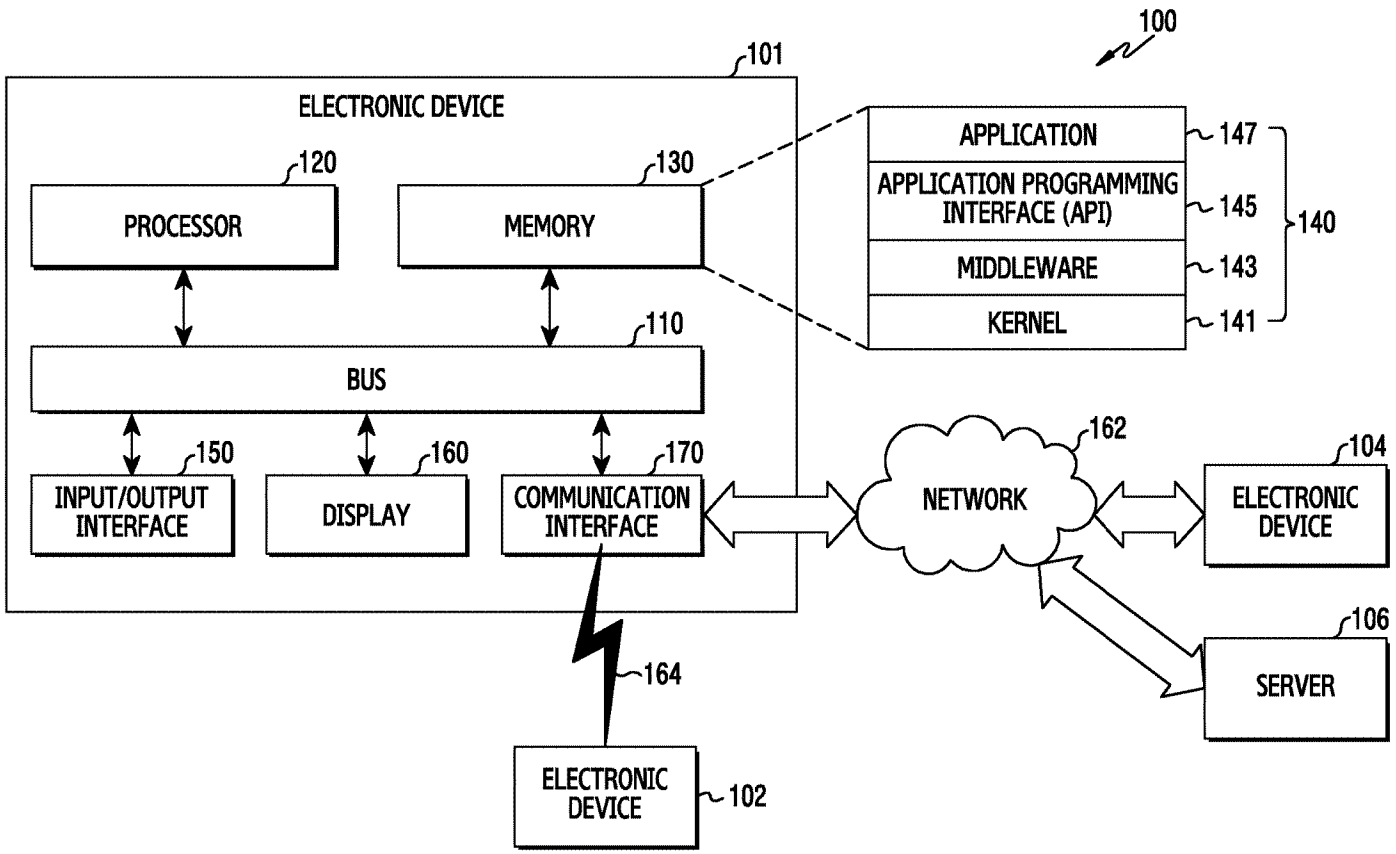
FIG. 1 is a block diagram illustrating an electronic device within a network environment according to various embodiments.

Hereinafter, embodiments of the present disclosure will be described in connection with the accompanying drawings.

The present disclosure may have various embodiments, and modifications and changes may be made therein. Therefore, the present disclosure will be described in detail with reference to particular embodiments shown in the accompanying drawings. However, it should be understood that the present disclosure is not limited to the particular embodiments, but includes all modifications, equivalents, and/or alternatives within the spirit and scope of the present description. In the description of the drawings, similar reference numerals may be used to designate similar elements.

As used in describing embodiments of the present disclosure, the expressions "include", "may include" and other conjugates refer to the existence of a corresponding disclosed function, operation, or constituent element, and do not limit one or more additional functions, operations, or constituent elements. Further, as used to describe the embodiments of the present disclosure, the terms "include", "have", and their conjugates merely denote a certain feature, numeral, step, operation, element, component, or a combination thereof, and do not exclude the existence or possibility of addition of one or more other features, numerals, steps, operations, elements, components, or combinations thereof.

In describing embodiments of the present disclosure, the expression "or" or "at least one of A or/and B" includes any or all of combinations of words listed together. For example, the expression "A or B" or "at least A or/and B" may include A, may include B, or may include both A and B.

In the present disclosure, expressions including ordinal numbers, such as "first" and "second," etc., may modify various elements. However, such elements are not limited by the above expressions. For example, the above expressions do not limit the sequence and/or importance of the elements. The above expressions are used merely for the purpose of distinguishing an element from the other elements. For example, a first user device and a second user device indicate different user devices although both of them are user devices. For example, a first element may be referred to as a second element, and likewise a second element may also be referred to as a first element without departing from the scope of embodiments of the present disclosure.

When an element is referred to as being "coupled" or "connected" to any other element, it should be understood that not only the element may be coupled or connected directly to the other element, but also a third element may be interposed therebetween. Contrarily, when an element is referred to as being "directly coupled" or "directly connected" to any other element, it should be understood that no other element is interposed therebetween.

The terms used in embodiments of the present disclosure are used merely to describe one or more certain embodiments and are not intended to limit the present disclosure. As used herein, singular forms may include plural forms as well unless the context explicitly indicates otherwise. Furthermore, all terms used herein, including technical and scientific terms, have the same meaning as commonly understood by those of skill in the art to which the present disclosure pertains. Such terms as those defined in a generally used dictionary are to be interpreted to have the same meanings as the contextual meanings in the relevant field of art, and are not to be interpreted to have ideal or excessively formal meanings unless clearly defined in embodiments of the present disclosure.

An electronic device according to the present disclosure may be a device including a communication function. For example, the electronic device may include at least one of a Smartphone, a Tablet Personal Computer (PC), a Mobile Phone, a Video Phone, an Electronic Book (e-book) reader, a Desktop PC, a Laptop PC, a Netbook Computer, a Personal Digital Assistant (PDA), a portable multimedia player (PMP), an MP3 player, a Mobile Medical Appliance, a Camera, and a Wearable Device (e.g. a head-mounted-device, such as electronic glasses, electronic clothes, an electronic bracelet, an electronic necklace, an electronic appcessory, electronic tattoos, or a smartwatch).

According to certain embodiments, the electronic device may be a smart home appliance with a communication function. For example, the smart home appliance may include at least one of a television, a digital video disk (DVD) player, an audio, a refrigerator, an air conditioner, a vacuum cleaner, an oven, a microwave oven, a washing machine, an air cleaner, a set-top box, a TV box (e.g., Samsung HomeSync™, Apple TV™, or Google TV™), a game console, an electronic dictionary, an electronic key, a camcorder, and an electronic photo frame.

According to certain embodiments, the electronic device may include at least one of various medical appliances (e.g., magnetic resonance angiography (MRA), magnetic resonance imaging (MRI), computed tomography (CT), and ultrasonic machines), navigation equipment, a global positioning system (GPS) receiver, an event data recorder (EDR), a flight data recorder (FDR), automotive infotainment device, electronic equipment for ships (e.g., ship navigation equipment and a gyrocompass), avionics, security equipment, a vehicle head unit, an industrial or home robot, an automatic teller machine (ATM) of a banking system, and a point of sales (POS) of a shop.

According to certain embodiments, the electronic device may include at least one of a part of furniture or a building/structure, an electronic board, an electronic signature receiving device, a projector, and various kinds of measuring instruments (e.g., a water meter, an electric meter, a gas meter, and a radio wave meter).

The electronic device according to the present disclosure may be a combination of one or more of the aforementioned various devices. Further, the electronic device according to the present disclosure may be a flexible device. Further, it will be apparent to those skilled in the art that the electronic device according to the present disclosure is not limited to the aforementioned devices.

Hereinafter, an electronic device according to the present disclosure will be described with reference to the accompanying drawings. The term "user" as used in embodiments of the present disclosure may indicate a person who uses an electronic device or a device (e.g., artificial intelligence electronic device) that uses an electronic device.

FIG. 1 is a block diagram of an example of a network environment, according to the present disclosure.

Referring to FIG. 1, an electronic device 101 includes at least one of a bus 110, a processor 120, a memory 130, an input/output interface 150, a display 160, and a communication interface 170. According to the present disclosure, at least one of the components of the electronic device 101 may be omitted, or other components may be additionally included in the electronic device 101.

The bus 110 is a circuit that interconnects the aforementioned elements and transmits communication signals (e.g., control messages) between the aforementioned elements.

The processor 120 carries out operations or data processing related to control and/or communication of at least one other component (for example, the memory 130, the input/output interface 150, the display 160, or the communication interface 170) of the electronic device 101.

The memory 130 stores commands or data (e.g., a reference pattern or a reference touch area) associated with one or more other components of the electronic device 101. According to one embodiment, the memory 130 stores software 100 that may include a program 140. For example, the program 140 includes a kernel 141, a middleware 143, an application programming interface (API) 145, an application program 147, or the like, with one or more of the kernel 141, the middleware 143, and the API 145 being referred to as an Operating System (OS).

The kernel 141 controls or manages system resources (e.g., the bus 110, the processor 120, or the memory 130) used for performing an operation or function implemented by the other programs (e.g., the middleware 143, the API 145, or the application program 147). Furthermore, the kernel 141 provides an interface through which the middleware 143, the API 145, or the application program 147 may access the individual elements of the electronic device 101 to control or manage the system resources.

The middleware 143, for example, functions as an intermediary for allowing the API 145 or the application program 147 to communicate with the kernel 141 to exchange data. In addition, the middleware 143 processes one or more task requests received from the application program 147 according to priorities thereof. For example, the middleware 143 assigns priorities for using the system resources (e.g., the bus 110, the processor 120, the memory 130, or the like) of the electronic device 101, to at least one application of the application program 147. For example, the middleware 143 performs scheduling or loading balancing on the one or more task requests by processing the one or more task requests according to the priorities assigned thereto.

The API 145 is an interface through which the application 147 controls functions provided from the kernel 141 or the middleware 143, and may include, for example, at least one interface or function (e.g., instruction) for file control, window control, image processing, or text control.

The input/output interface 150 forwards instructions or data input from a user through an input/output device (e.g., various sensors, such as an acceleration sensor or a gyro sensor, and/or a device such as a keyboard or a touch screen), to the processor 120, the memory 130, or the communication interface 170 through the bus 110. For example, the input/output interface 150 provides the processor 120 with data on a user' touch entered on a touch screen. Furthermore, the input/output interface 150 outputs instructions or data, received from, for example, the processor 120, the memory 130, or the communication interface 170 via the bus 110, through an output unit (e.g., a speaker or the display 160).

The display 160 includes, for example, a liquid crystal display (LCD), a light emitting diode (LED) display, an organic LED (OLED) display, a micro electro mechanical system (MEMS) display, an electronic paper display, and the like. The display 160, for example, displays various types of content (e.g., a text, images, videos, icons, symbols, and the like) for the user. The display 160 may include a touch screen and receive, for example, a touch, a gesture, proximity, a hovering input, and the like, using an electronic pen or the user's body part. According to an embodiment of the present disclosure, the display 160 may display a web page.

The communication interface 170, for example, sets communication between the electronic device 101 and an external device (e.g., a first external electronic device 102, a second external electronic device 104, or a server 106). For example, the communication interface 170 connects to a network 162 through wireless or wired communication to communicate with the external device (e.g., the second external electronic device 104 or the server 106).

The wireless communication may use at least one of, for example, long term evolution (LTE), LTE-advance (LTE-A), code division multiple access (CDMA), wideband CDMA (WCDMA), universal mobile telecommunications system (UMTS), wireless broadband (WiBro), and global system for mobile communications (GSM), as a cellular communication protocol. In addition, the wireless communication may include, for example, a short range communication 164. The short-range communication 164 may include at least one of, for example, wireless fidelity (Wi-Fi), Bluetooth™ (BT), near field communication (NFC), and GPS.

Each of the first external electronic device 102 and the second external electronic device 104 may be a device which is the same as or different from the electronic device 101. According to an embodiment of the present disclosure, the server 106 may include a group of one or more servers. According to the present disclosure, all or a part of operations performed in the electronic device 101 can be performed in the other electronic device or multiple electronic devices (e.g., the first external electronic device 102 or the second external electronic device 104 or the server 106). According to an embodiment of the present disclosure, when the electronic device 101 should perform some functions or services automatically or by a request, the electronic device 101 may make a request for performing at least some functions related to the functions or services by another device (e.g., the first external electronic device 102, the second external electronic device 104, or the server 106) instead of performing the functions or services by itself. The first external electronic device 102, the second external electronic device 104, or the server 106 may perform a function requested from the electronic device 101 or an additional function and transfer the performed result to the electronic device 101. The electronic device 101 can provide the requested function or service to another electronic device by processing the received result as it is or additionally. To this end, for example, cloud computing, distributed computing, or client-server computing technology may be used.

Figure 2:
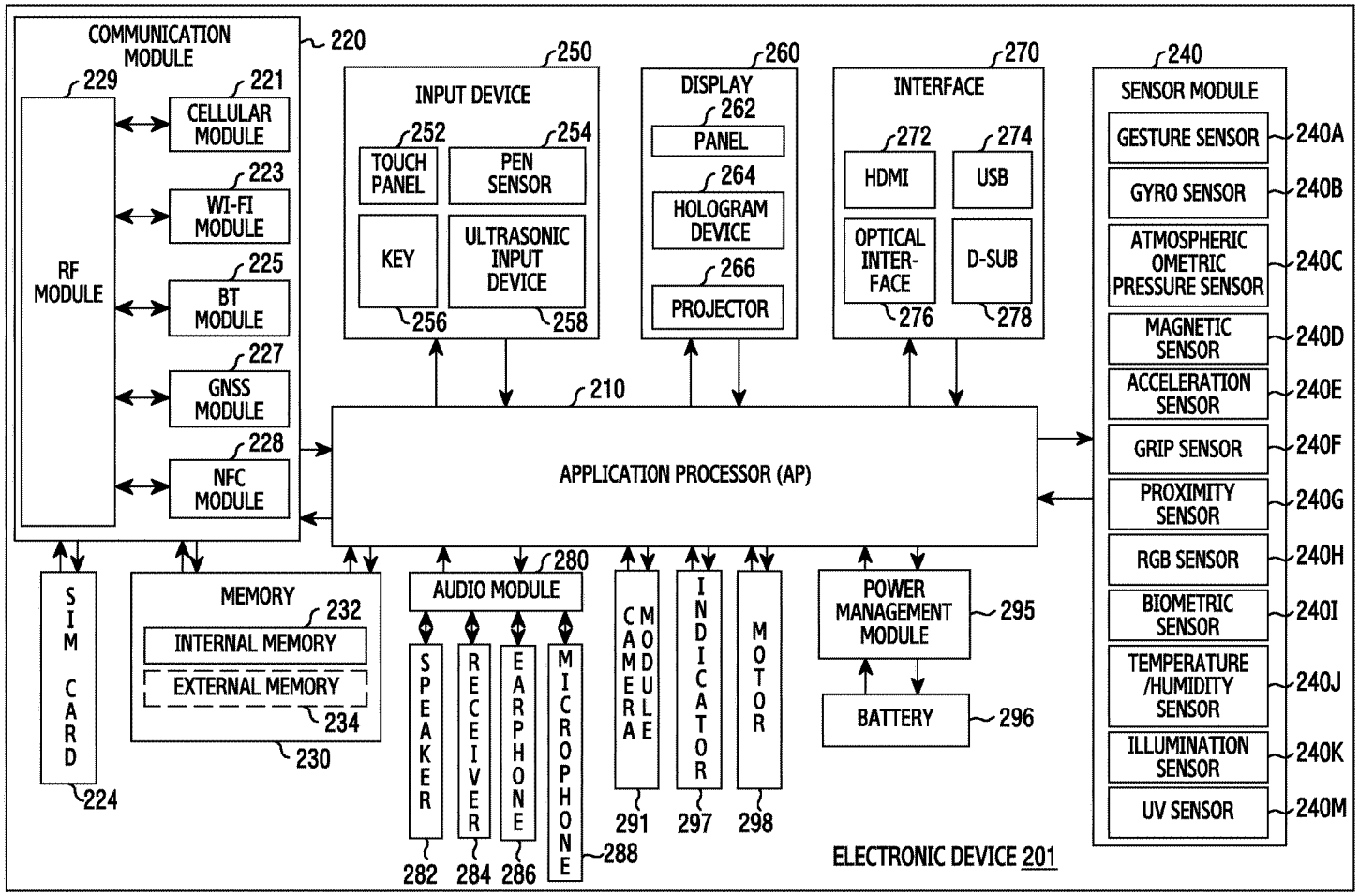
FIG. 2 is a block diagram illustrating an electronic device according to various embodiments.

FIG. 2 is a block diagram of an example of an electronic device, according to the present disclosure.

The electronic device 201 may constitute, for example, the entirety or a part of the electronic device 101 illustrated in FIG. 1, or may expand all or some elements of the electronic device 101. Referring to FIG. 2, the electronic device 201 includes an application processor (AP) 210, a communication module 220, a subscriber identification module (SIM) card 224, a memory 230, a sensor module 240, an input device 250, a display 260, an interface 270, an audio module 280, a camera module 291, a power management module 295, a battery 296, an indicator 297, and a motor 298.

The AP 210 runs an operating system or an application program to control a plurality of hardware or software constituent elements connected to the AP 210, and may perform processing and operation of various data including multimedia data. The AP 210 may be, for example, implemented as a system on chip (SoC). According to an embodiment of the present disclosure, the AP 210 further includes a graphical processing unit (GPU). The AP 210 further includes at least one of other constitute elements (e.g., the cellular module 221). The AP 210 loads an instruction or data, which is received from a non-volatile memory connected to each or at least one of other constituent elements, to a volatile memory and processes the loaded instruction or data. In addition, the AP 210 stores in the non-volatile memory, data received from at least one of the other constituent elements or generated by at least one of the other constituent elements.

The communication module 220 (e.g., the communication interface 170) performs data transmission/reception in communication between the electronic device 201 (e.g., the electronic device 101) and other electronic devices connected through a network. According to an embodiment of the present disclosure, the communication module 220 includes cellular module 221, a Wi-Fi module 223, a BT module 225, a GPS module 227, an NFC module 228, and a radio frequency (RF) module 229.

The cellular module 221 provides a voice telephony, a video telephony, a text service, an Internet service, and the like, through a telecommunication network (e.g., LTE, LTE-A, CDMA, WCDMA, UMTS, WiBro, GSM, and the like). In addition, the cellular module 221 may, for example, use a SIM card 224 to perform electronic device distinction and authorization within the telecommunication network. According to an embodiment of the present disclosure, the cellular module 221 may perform at least some of functions that the AP 210 may provide. For example, the cellular module 221 performs at least one part of a multimedia control function.

The WiFi module 223, the BT module 225, the GPS module 227 and the NFC module 228 each may include, for example, a processor for processing data transmitted/received through the corresponding module. According to an embodiment of the present disclosure, at least some (e.g., two or more) of the cellular module 221, the WiFi module 223, the BT module 225, the GPS module 227 and the NFC module 228 are included within one IC or IC package.

The RF module 229 performs transmission/reception of data, for example, transmission/reception of an RF signal. The RF module 229 may include, for example, a transceiver, a power amplifier module (PAM), a frequency filter, a low noise amplifier (LNA), an antenna and the like. According to an embodiment of the present disclosure, at least one of the cellular module 221, the WiFi module 223, the BT module 225, the GPS module 227 or the NFC module 228 may perform transmission/reception of an RF signal through a separate RF module.

The SIM card 224 includes a SIM, and may be inserted into a slot provided in a specific position of the electronic device 201. The SIM card 224 includes unique identification information (e.g., an integrated circuit card ID (ICCID)) or subscriber information (e.g., an international mobile subscriber identity (IMSI)).

The memory 230 includes an internal memory 232 or an external memory 234. The internal memory 232 includes, for example, at least one of a volatile memory (e.g., a dynamic random access memory (DRAM), a static RAM (SRAM) and a synchronous DRAM (SDRAM)) or a non-volatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a not and (NAND) flash memory, and a not or (NOR) flash memory).

According to an embodiment of the present disclosure, the internal memory 232 may be a solid state drive (SSD). The external memory 234 may further include a flash drive, for example, compact flash (CF), secure digital (SD), micro-SD, mini-SD, extreme digital (xD), a memory stick, and the like. The external memory 234 may be operatively connected with the electronic device 201 through various interfaces.

The sensor module 240 measures a physical quantity or detects an activation state of the electronic device 101, and converts measured or detected information into an electric signal. The sensor module 240 includes, for example, at least one of a gesture sensor 240A, a gyro sensor 240B, an air pressure sensor 240C, a magnetic sensor 240D, an acceleration sensor 240E, a grip sensor 240F, a proximity sensor 240G, a color sensor 240H (e.g., a red, green, blue (RGB) sensor), a bio-physical sensor 240I, a temperature/humidity sensor 240J, an illumination sensor 240K, a ultraviolet (UV) sensor 240M, and the like. Additionally or alternatively, the sensor module 240 may also include, for example, an E-nose sensor, an electromyography (EMG) sensor, an electroencephalogram (EEG) sensor, an electrocardiogram (ECG) sensor, an infrared (IR) sensor, an iris sensor, a fingerprint sensor, and the like. The sensor module 240 may further include a control circuit for controlling at least one or more sensors belonging therein.

The input device 250 includes a touch panel 252, a (digital) pen sensor 254, a key 256, an ultrasonic input device 258, and the like. The touch panel 252 may, for example, detect a touch input in at least one of a capacitive overlay scheme, a pressure sensitive scheme, an infrared beam scheme, and an acoustic wave scheme. The touch panel 252 may also include a control circuit. In a case of the capacitive overlay scheme, physical contact or proximity detection is possible. The touch panel 252 may further include a tactile layer, to provide a tactile response to a user.

The (digital) pen sensor 254 may be implemented in the same or similar method to receiving a user's touch input or by using a separate sheet for detection. The key 256 may include, for example, a physical button, an optical key, or a keypad. The ultrasonic input device 258 is capable of identifying data by detecting a sound wave in the electronic device 201 through an input tool generating an ultrasonic signal, and enables wireless detection. According to an embodiment of the present disclosure, the electronic device 201 may also use the communication module 220 to receive a user input from a connected external device (e.g., a computer or a server).

The display 260 (e.g., the display 160) includes a panel 262, a hologram device 264, or a projector 266. The panel 262 may be, for example, an LCD, an Active-Matrix Organic LED (AMOLED), and the like. The panel 262 may be, for example, implemented to be flexible, transparent, or wearable. The panel 262 may be constructed as one module along with the touch panel 252 as well. The hologram device 264 may use interference of light to show a three-dimensional image in the air. The projector 266 may project light to a screen to display an image. The screen may be, for example, located inside or outside the electronic device 201. According to an embodiment of the present disclosure, the display 260 may further include a control circuit for controlling the panel 262, the hologram device 264, or the projector 266.

The interface 270 includes, for example, a high-definition multimedia interface (HDMI) 272, a universal service bus (USB) 274, an optical interface 276, or a D-subminiature (D-sub) 278. Additionally or alternatively, the interface 270 includes, for example, a mobile high-definition link (MHL) interface, an SD card/multimedia card (MMC) interface or an infrared data association (IrDA) standard interface.

The audio module 280 converts a voice and an electric signal interactively. The audio module 280 may, for example, process sound information which is inputted or outputted through a speaker 282, a receiver 284, an earphone 286, the microphone 288, and the like.

The camera module 291 takes still pictures and moving pictures. According to an embodiment of the present disclosure, the camera module 291 includes one or more image sensors (e.g., a front sensor or a rear sensor), a lens, an image signal processor (ISP), or a flash (e.g., an LED or a xenon lamp).

The power management module 295 manages electric power of the electronic device 201. The power management module 295 includes, for example, a power management integrated circuit (PMIC), a charger IC, a battery, a battery gauge, and the like.

The PMIC may be, for example, mounted within an integrated circuit or an SoC semiconductor. A charging scheme may be divided into a wired charging scheme and a wireless charging scheme. The charger IC charges the battery 296, and prevents the inflow of overvoltage or overcurrent from an electric charger. According to an embodiment of the present disclosure, the charger IC includes a charger IC for at least one of the wired charging scheme or the wireless charging scheme. The wireless charging scheme may, for example, be a magnetic resonance scheme, a magnetic induction scheme, an electromagnetic wave scheme, and the like. A supplementary circuit for wireless charging, for example, a circuit, such as a coil loop, a resonance circuit, a rectifier, and the like, may be added.

The battery gauge may, for example, measure a level of the battery 296, a voltage during charging, a current or a temperature. The battery 296 generates or stores electricity, and uses the stored or generated electricity to supply power to the electronic device 201. The battery 296 may include, for example, a rechargeable battery or a solar battery.

The indicator 297 displays a specific status of the electronic device 201 or one part (e.g., the AP 210) thereof, for example a booting state, a message state, a charging state, and the like. The motor 298 may convert an electric signal into a mechanical vibration. The electronic device 101 may include a processing device (e.g., a GPU) for mobile TV support. The processing device for mobile TV support may, for example, process media data according to the standards of digital multimedia broadcasting (DMB), digital video broadcasting (DVB), a media flow, and the like.

Each of the above-described elements of the electronic device may include one or more components, and the name of a corresponding element may vary according to the type of electronic device. The electronic device according to the present disclosure may include at least one of the above-described elements and may exclude some of the elements or further include other additional elements. Further, some of the elements of the electronic device according to the present disclosure may be coupled to form a single entity while performing the same functions as those of the corresponding elements before the coupling.

Figure 3:
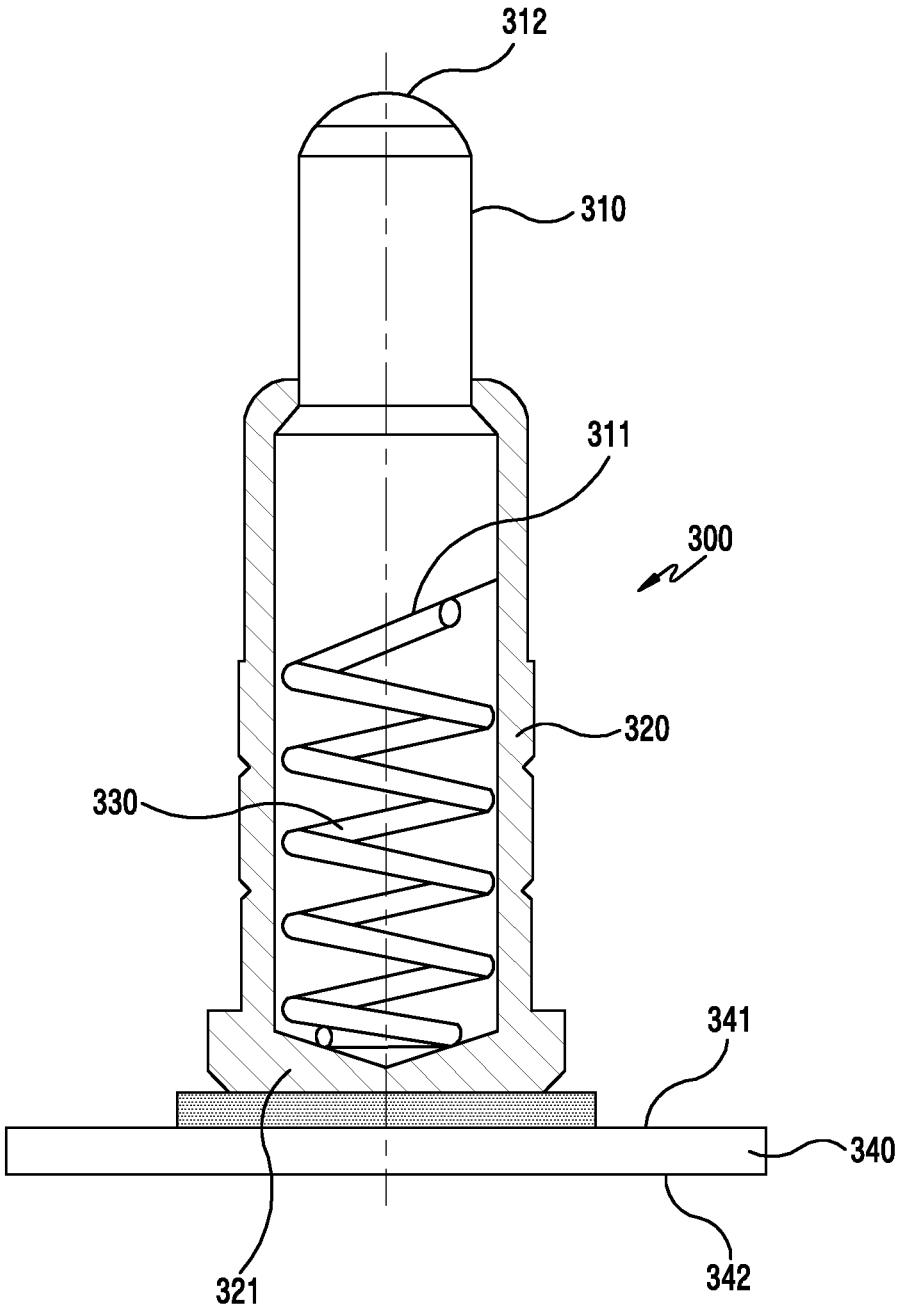
FIG. 3 is a sectional view of a unidirectional connector according to various embodiments.

FIG. 3 is a sectional view illustrating a unidirectional connector 300 mounted to an electronic device according to various embodiments.

Referring to FIG. 3, the unidirectional connector 300 according to various embodiments may include a connection member 310 having a first end 312, a hollow housing 320, and an elastic member 330. The connection member 310 according to various embodiments, which is approximately a part connected to a counterpart object (not illustrated), can maintain a closed contact with the counterpart object by the elastic member 330 while being included in the hollow housing 320. For example, the counterpart object may be a printed circuit board, another electronic device, or an external device.

The connection member 310, the hollow housing 320, and the elastic member 330 constituting the unidirectional connector 300 according to various embodiments may include a conductive material, and a substrate 340, which may include an upper surface 341 and a lower surface 342, may be electrically conducted to the counterpart object by the unidirectional connector 300. One end 321 of the hollow member 320 connected to the substrate 340 by soldering can be conducted to one end of the elastic member 330, and the other end 311 of the elastic member 330 can be conducted to one end of the connection member 310. An one-directional movement of the conductive member 310 can be guided by the hollow member 320. The one end of the conductive member 310 may have a semi-spherical shape and have a structure advantageous for maintaining a close contact state.

Figure 4:
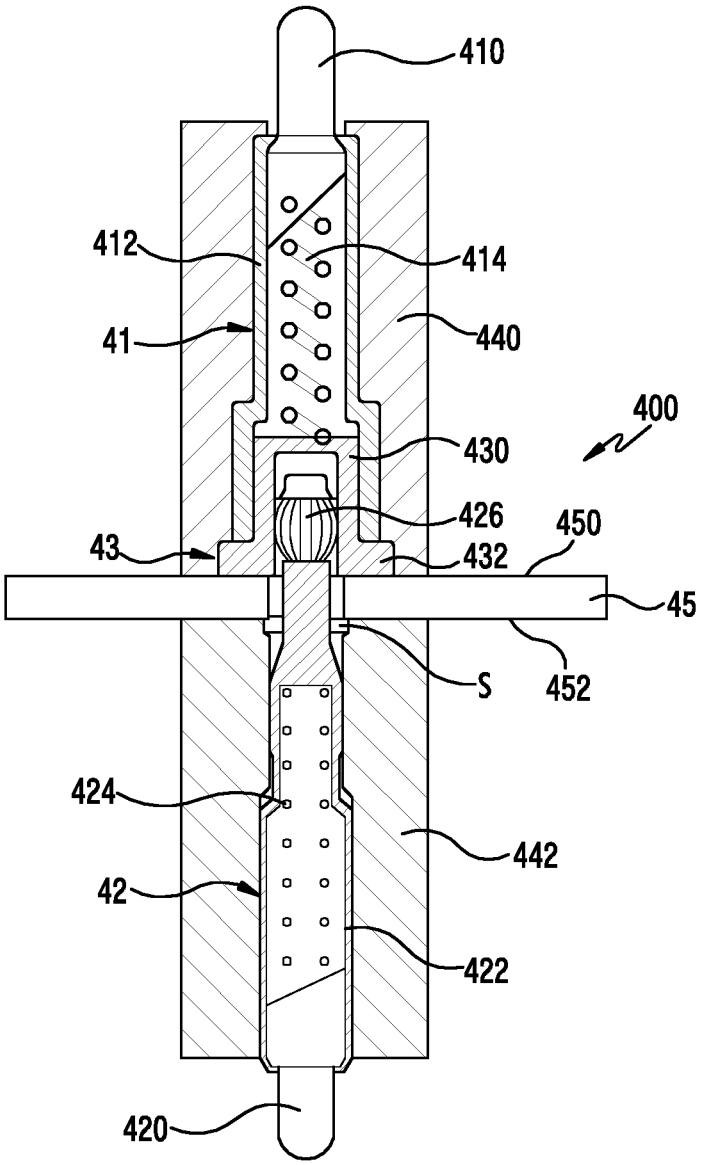
FIG. 4 is a sectional view of a bidirectional connector according to various embodiments of the present disclosure.

FIG. 4 is a sectional view illustrating a bidirectional connector according to various embodiments of the present disclosure.

Referring to FIG. 4, an electronic device may include a connector 400 according to various embodiments of the present disclosure. The connector 400 may include a substrate 45, a first connector 41 mounted to the substrate 45 in a first direction, a second connector 42 mounted to the substrate in a second direction opposite to the first direction, and a connection member 43 for connecting the first and second connectors 41 and 42.

The connector 400 according to various embodiments may be a bidirectional connector. The bidirectional connector 400 may include a first connector 41 facing the first direction, and a second connector 42 facing the second direction, which is opposite to the first direction. Further, the bidirectional connector 400 according to various embodiments may include the first and second connectors 41 and 42 arranged while being integrally assembled to the substrate 45. Further, the bidirectional connector 400 according to various embodiments may include a first connector 41 made of a conductive material, a second connector 42 made of a conductive material, and a connection member 43 made of a conductive material.

The first connector 41 according to various embodiments may include a first conductive member 410, a first hollow member 412, a first elastic member 414, and a first insulation structure 440. The first connector 41 may be arranged on a first surface 450 of the substrate or may be arranged to stand upright in a perpendicular direction to the first surface 450.

The first conductive member 410 according to various embodiments may be a connection part which can be in contact with the counterpart object (not illustrated) while moving along the first hollow member 412 in a state in which the first conductive member 410 is received in the first hollow member 412. The first conductive member 410 has one end received in the first hollow member 412 and the other end exposed to the outside of the first hollow member 412. The first conductive member 410 can be always supported by the first elastic member 414 in a direction in which the first conductive member 410 becomes farther away from the first hollow member 412 and can move in the lengthwise direction of the first hollow member 412 in a supported state. The other end of the first conductive member 410 can maintain a connection state to one end of the first elastic member 414.

The first hollow member 412 according to various embodiments, which is a guide housing for receiving at least a part of the first conductive member 410 and the first elastic member 414, may have one opened end, and the other end closed by the connection member 43. The one end of the first hollow member 412 may be an opening through which the first conductive member 410 is arranged and moved, and the other end thereof may be a part to which the connection member 43 may be coupled. An outer appearance of the first hollow member 412 according to various embodiments has a cylindrical shape and at least a part thereof may have an inner diameter or an outer diameter. The first conductive member 410 can be restrained by the one end of the first hollow member 412.

The second connector 42 according to various embodiments may include a second conductive member 420, a second hollow member 422, a second elastic member 424, a connection member 426, and a second insulation structure 442. The second connector 42 according to various embodiments may be arranged on a second surface 452 of the substrate or may be arranged to stand upright in a perpendicular direction to the second surface 452. The connection member 426 according to various embodiments may be a multi-connection member.

The second conductive member 420 according to various embodiments may be a connection part which can be in contact with the counterpart object while moving along the second hollow member 422 in a state in which the second conductive member 420 may be received in the second hollow member 422. The second conductive member 420 has one end received in the second hollow member 422 and the other end exposed to the outside of the second hollow member 422. The second conductive member 420 can be supported by the second elastic member 424 in a direction in which the second conductive member 420 becomes farther away from the second hollow member 422 and can move in the lengthwise direction of the second hollow member 422 in an elastically supported state. The other end of the second conductive member 420 can maintain a connection state to one end of the second elastic member 424.

The second hollow member 422 according to various embodiments may be a guide housing for receiving at least a part of the second conductive member 420 or the second elastic member 424. Otherwise, the one end of the second hollow member 422 may be an opened end and the other end thereof may be a closed end at which the connection member 426 may be arranged. The one end of the second hollow member 422 may be an opening through which the second conductive member 420 may be arranged and moved, and the other end thereof may be a part to which the connection member 43 may be coupled. An outer appearance of the second hollow member 422 according to various embodiments has a cylindrical shape and at least a part thereof may have an inner diameter or an outer diameter. The second conductive member 420 can be restrained by the one end of the second hollow member 422.

The connection member 426 of the second connector according to various embodiments may be a connection part coupled and connected to the connection member 43 in a multi-contact point structure. The connection member 426 may include a plurality of connection members, have a shape convex to the outside, and have elasticity. At least a part of the connection member 426 and the inner surface of the connection member 43 can provide a plurality of contact point parts at a plurality of points. Such a multi-contact point structure can provide stability of connection. The connection member 426 can be configured integrally with the second hollow member 422, and can provide a state in which the connection member 426 may be connected to the connection member 43 while being arranged in the connection member 43.

The connection member 43 according to various embodiments may be a connection member for electrically connecting the first connector 41 and the second connector 42. The connection member 43 according to various embodiments can be press-fitted in the other end of the first hollow member 412 to be integrally coupled to the first connector 41. The connection member 43, which may be a connection component made of a conductive material, may include a press-fit part 430 having a first diameter, and a non-press-fit part 432 having a second diameter different from the first diameter.

The connection member 43 according to various embodiments may have a hollow shape of which the interior may be empty. One end thereof may be a closed end, and the other end thereof may be an opened end. The press-fit part 430 may be press-fitted in the other end of the first hollow member 412 so as to be an integral type, and the non-press-fit part 432 may be a part which may be exposed at the other end of the first hollow member 412 and fixed to the substrate 45. The interior of the connection member 43 may be an empty space, and may be a part in which the multi-connection member 426 may be arranged on the inner surface thereof and which enables the connection member 43 to be connected to the multi-connection member 426 in a multi-contact-point scheme.

The first insulation structure 440 according to various embodiments may be an insulation and support body formed to surround the first connector 41 so as to support the first connector 41. The first insulation structure 440 may be arranged on the first surface 450 of the substrate.

The second insulation structure 442 according to various embodiments may be an insulation and support body formed to surround the second connector 42 so as to support the second connector 42. The first and second insulation structures 440 and 442 may be arranged to be symmetric to each other with reference to the substrate 45. The second insulation structure 442 may be arranged on the second surface 452 of the substrate.

The above-configured bidirectional connector 400 may be connected to the counterpart object (not illustrated) to provide first and second electric paths.

The electric paths according to various embodiments may include a first electric path provided by the first connector 41 and the connection member 43 and a second electric path provided by the second connector 42.

The first electric path according to various embodiments may include a first conductive member 410, a first elastic member 414 which may be always in contact with the first conductive member 410, a connection member 43 which may always in contact with the first elastic member 414, and a multi-connection member 426 which may always be in contact with the connection member 43. The first electric path according to various embodiments can be formed within the substrate 45 so as to be connected to the connection member 43. The second electric path according to various embodiments may include a second conductive member 420, a second elastic member 424 which may be in contact with the second conductive member 424, a multi-connection member 426 which may be in contact with the second elastic member 424, and a connection member 43 which may be in contact with the multi-connection member 426. The second electric path according to various embodiments can be formed within the substrate 45 so as to be connected to the second connector 42.

According to an embodiment, reference numeral s may be a soldering part. The soldering part s can fix the second connector to the second surface of the substrate.

Figure 5:
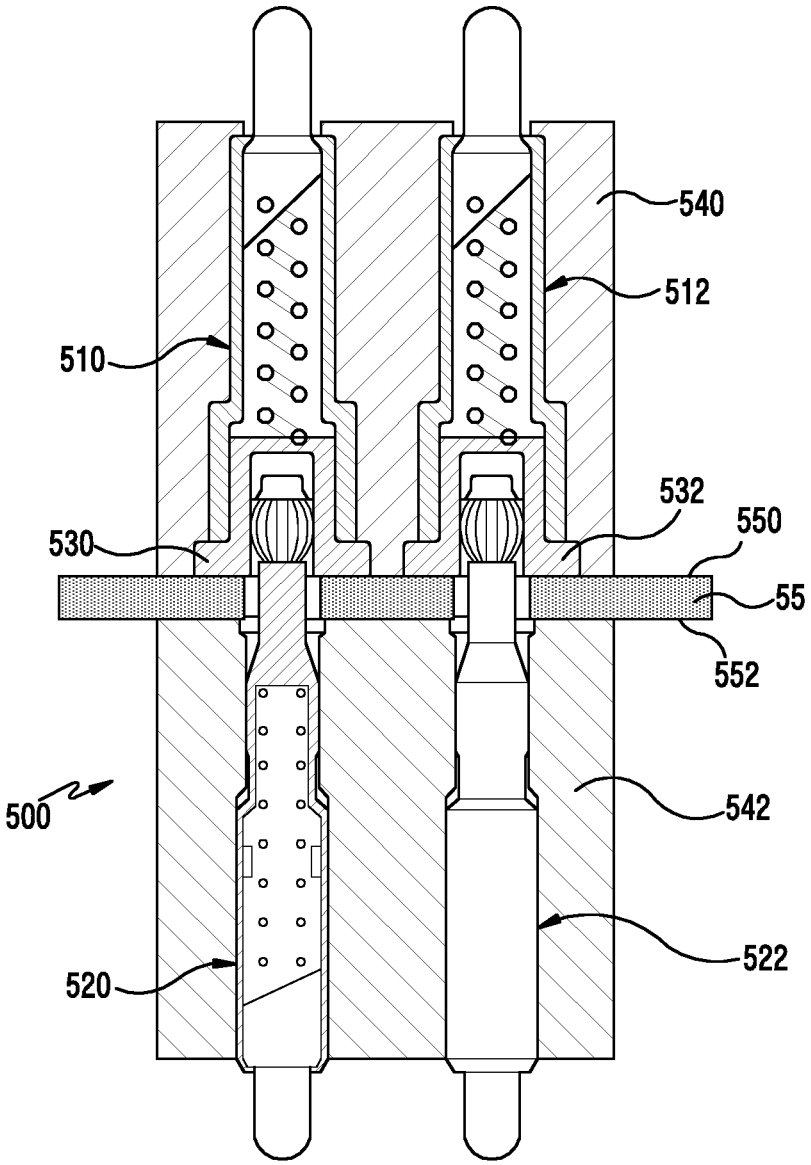
FIG. 5 is a sectional view of a bidirectional connector array according to various embodiments of the present disclosure.

FIG. 5 is a sectional view illustrating a n aligned bidirectional connector array according to various embodiments of the present disclosure.

Referring to FIG. 5, a bidirectional connector 500 mounted to an electronic device according to various embodiments may include a substrate 55, at least a pair of first and second connectors 510 and 512 aligned on a first surface 550 of the substrate side by side, at least a pair of third and fourth connectors 520 and 522 aligned on a second surface 552 of the substrate side by side, and at least a pair of connection members 530 and 532 aligned on the first surface 550 of the substrate. In the bidirectional connector according to various embodiments, a plurality of (e.g., two) first connectors are aligned on the first surface of the substrate, and thus, may be called a first connector array, and a plurality of (e.g., two) second connectors are aligned on the second surface of the substrate, and thus, may be called a second connector array. Thus, a part consisting of the first and second connector arrays may be called a bidirectional connector array.

Since each of the first and second connectors 510 and 512 illustrated in FIG. 5 is identical or similar to the first connector 41 illustrated in FIG. 4, a detailed description thereof will be omitted. Since the third and fourth connectors 520 and 522 illustrated in FIG. 5 are identical or similar to the second connector 42 illustrated in FIG. 4, a detailed description thereof will be omitted. Since the connection members 530 and 532 illustrated in FIG. 5 are identical or similar to the connection member 43 illustrated in FIG. 4, a detailed description thereof will be omitted. Since the first and second insulation structures 540 and 542 illustrated in FIG. 5 are identical or similar to the first and second insulation structures 440 and 442 illustrated in FIG. 4, a detailed description thereof will be omitted.

Figure 6:
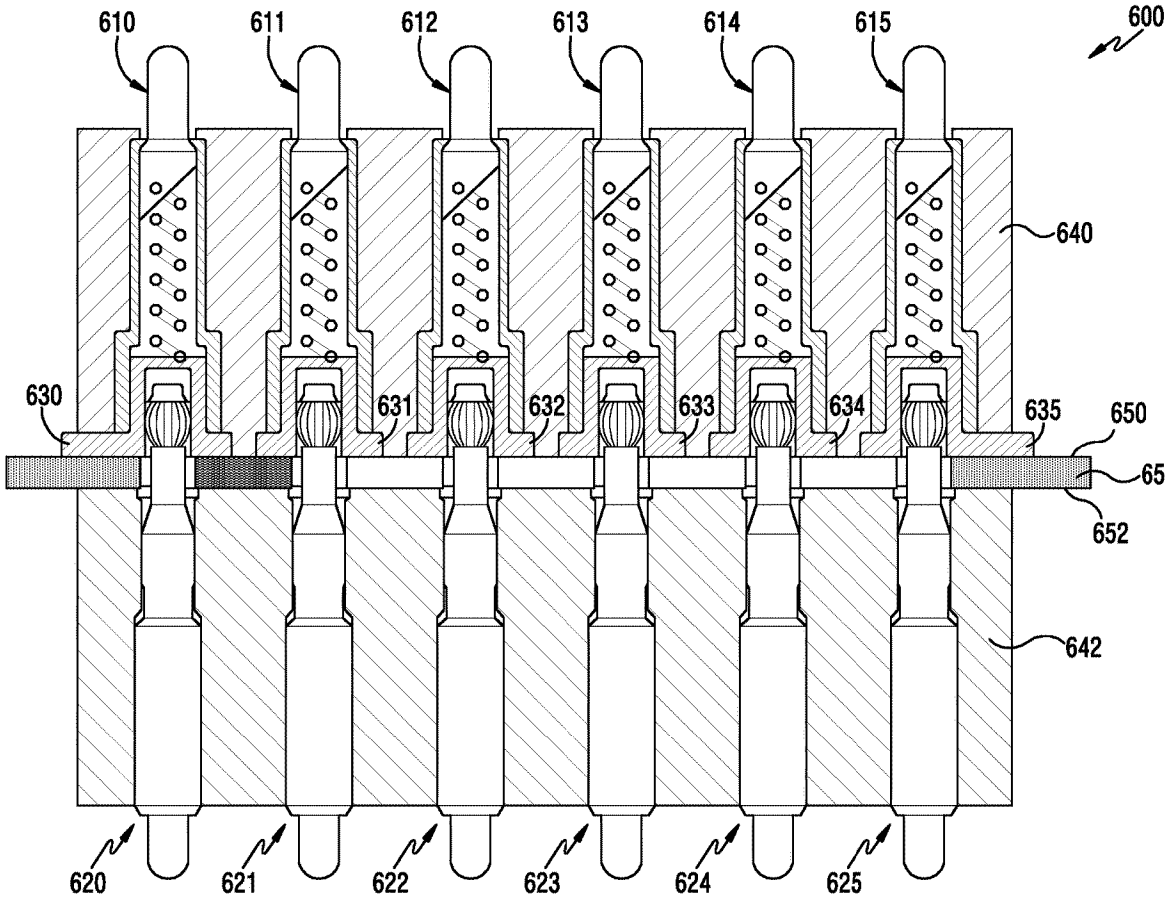
FIG. 6 is a sectional view of an aligned bidirectional connector array according to various embodiments of the present disclosure.

FIG. 6 is a sectional view illustrating a configuration of an aligned bidirectional connector array according to various embodiments of the present disclosure.

Referring to FIG. 6, a bidirectional connector 600 mounted to an electronic device according to various embodiments may include a substrate 65, a plurality of first connectors 610, 611, 612, 613, 614, and 615 aligned on a first surface 650 of the substrate side by side, a plurality of second connectors 620, 621, 622, 623, 624, and 625 aligned on a second surface 652 of the substrate side by side, and at least a pair of connection members 630 to 635 aligned on the first surface 650 of the substrate. Although illustrating as including six first and second connectors, respectively, a greater or lesser number of connectors may be used. Since each of the first connectors 610 to 615 illustrated in FIG. 6 are identical or similar to the first connector 41 illustrated in FIG. 4, a detailed description thereof will be omitted. Since each of the second connectors 620 to 625 illustrated in FIG. 6 are identical or similar to the second connector 42 illustrated in FIG. 4, a detailed description thereof will be omitted. Since each of the connection members 630 to 635 illustrated in FIG. 6 are identical or similar to the connection member 43 illustrated in FIG. 4, a detailed description thereof will be omitted. Since each of the first and second insulation structures 640 and 642 illustrated in FIG. 6 are identical or similar to the first and second insulation structures 440 and 442 illustrated in FIG. 4, a detailed description thereof will be omitted.

The plurality of first connectors 610 to 615 according to various embodiments may include the same connectors or may include different connectors. The plurality of second connectors 620 to 625 according to various embodiments may include the same connectors or may include different connectors. The first connectors 610 to 615 may be arranged to have a repeated arrangement. The second connectors 620 to 625 may be arranged to have a repeated arrangement.

Figure 7:
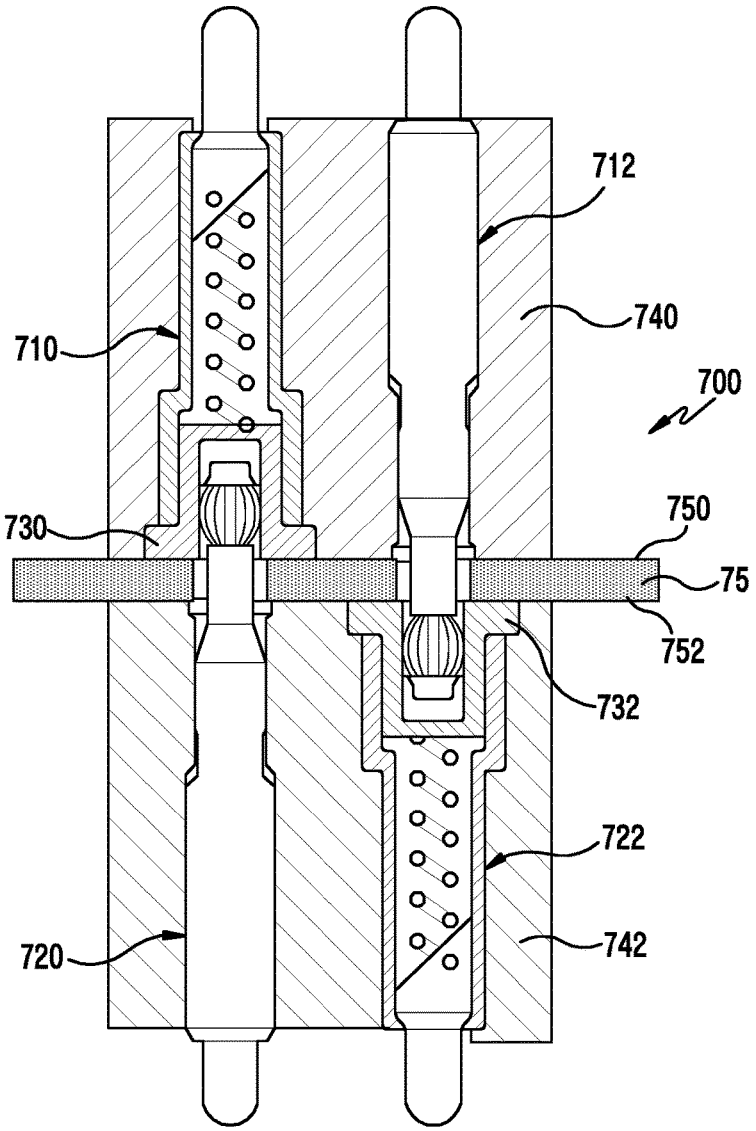
FIG. 7 is a sectional view of an aligned bidirectional connector array according to various embodiments of the present disclosure.

FIG. 7 is a sectional view illustrating a configuration of an aligned bidirectional connector array according to various embodiments of the present disclosure.

Referring to FIG. 7, a bidirectional connector 700 mounted to an electronic device according to various embodiments may include a substrate 75, a first connector 710 arranged on a first surface 750 of the substrate, a second connector 712 arranged on the first surface 750 of the substrate to be parallel to the first connector 710, a third connector 720 arranged on a second surface 752 of the substrate, a fourth connector 722 arranged on the second surface 752 of the substrate to be parallel to the third connector 720, a first connection member 730 arranged on the first surface 750 of the substrate between the first and third connectors 710 and 720, and a second connection member 722 arranged on the second surface 752 of the substrate between the second and fourth connectors 712 and 722.

The first and fourth connectors 710 and 722 according to various embodiments may be identical or similar to a configuration of the first connector 41 illustrated in FIG. 4. The second and third connectors 712 and 720 according to various embodiments may be identical or similar to a configuration of the second connector 42 illustrated in FIG. 4. The first and second connection members 730 and 732 according to various embodiments may be identical or similar to a configuration of the connection member 43 illustrated in FIG. 4. The first and second insulation structures 740 and 742 according to various embodiments may be identical or similar to a configuration of the first and second insulation structures 440 and 442 illustrated in FIG. 4, respectively.

According to various embodiments, the different connectors 710 and 712 can be aligned and arranged on the first surface 750 of the substrate, and the different connectors 720 and 722 can be aligned and arranged on the second surface 752 of the substrate.

For example, in the bidirectional connector 700 illustrated in FIG. 7, at least one first connector 710 and at least one second connector 712 having different configurations can be arranged on the first surface 750 of the substrate, and at least one third connector 720 and at least one fourth connector 722 having different configurations can be arranged on the second surface 752 of the substrate.

For example, the bidirectional connector 700 according to various embodiments can be configured such that locations of the first and second connectors 710 and 712 are changed with each other and locations of the third and fourth connectors 720 and 722 are changed with each other.

Figure 8:
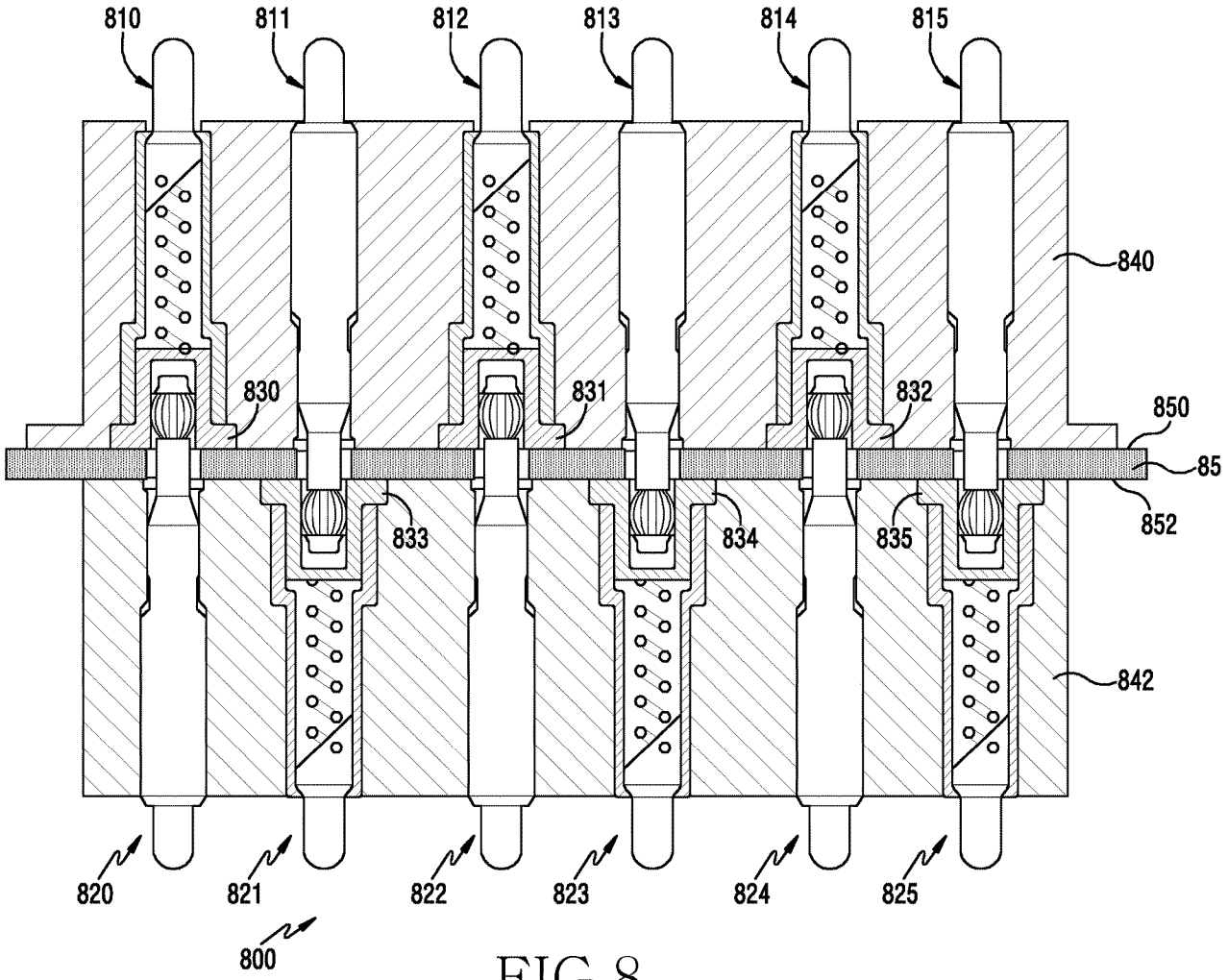
FIG. 8 is a sectional view of an aligned bidirectional connector array according to various embodiments of the present disclosure.

FIG. 8 is a sectional view illustrating a configuration of an aligned bidirectional connector array according to various embodiments of the present disclosure.

Referring to FIG. 8, a bidirectional connector 800 mounted to an electronic device according to various embodiments may include a substrate 85, a plurality of first connectors 810, 811, 812, 813, 814, and 815 aligned on a first surface 850 of the substrate side by side, a plurality of second connectors 820, 821, 822, 823, 824, and 825 aligned on a second surface 852 of the substrate side by side, and a plurality of first connection members 830 to 832 aligned on the first surface 850 of the substrate, and a plurality of second connection members 833 to 835 aligned on the second surface 852 of the substrate. Although illustrated as including six first and second connectors, respectively, a greater or lesser number of connectors may be used.

Each of the first connectors 810, 812, 814, 821, 823, and 825 illustrated in FIG. 8 may be identical or similar to the first connector 41 illustrated in FIG. 4. Each of the second connectors 811, 813, 815, 820, 822, and 824 illustrated in FIG. 8 may be identical or similar to the second connector 42 illustrated in FIG. 4. Each of the connection members 830 to 835 illustrated in FIG. 8 may be identical or similar to the connection member 43 illustrated in FIG. 4. The first and second insulation structures 840 and 842 illustrated in FIG. 8 may be identical or similar to configurations of the first and second connectors 440 and 442 illustrated in FIG. 4, respectively.

For example, the bidirectional connector 800 according to various embodiments can be configured such that one or more connectors having different configurations can be arranged on the first surface 850 of the substrate. Otherwise, one or more connectors having different configurations can be arranged on the second surface 852 of the substrate. The bidirectional connector 800 according to various embodiments can be configured such that a pair of connectors having different configurations can be regularly repeatedly aligned on the first surface 850 of the substrate. The bidirectional connector 800 according to various embodiments can be configured such that a pair of connectors having different configurations can be regularly repeatedly aligned on the second surface 852 of the substrate.

The plurality of first connectors 810 to 815 mounted on the first surface of the substrate according to various embodiments may include different connectors, and the plurality of second connectors 820 to 825 mounted on the second surface of the substrate may include different connectors. Further, the first connectors 810 to 815 may be repeatedly arranged, and the second connectors 820 to 825 may be repeatedly arranged.

Figure 9:
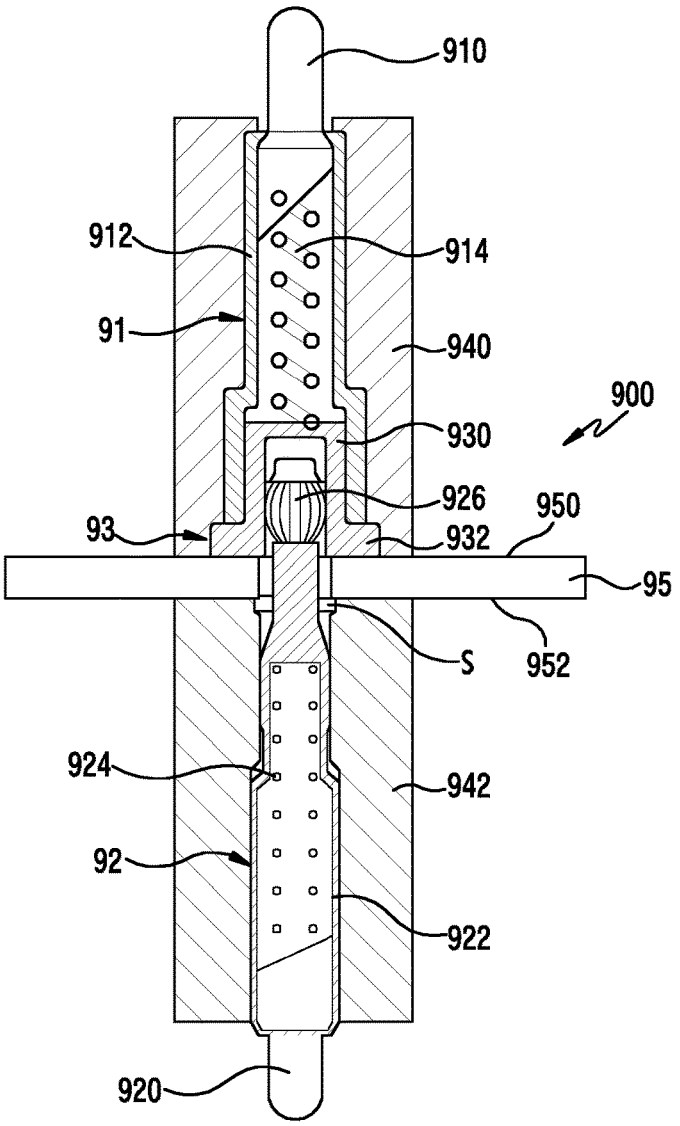
FIG. 9 is a sectional view of a bidirectional connector including a magnetic material according to various embodiments of the present disclosure.

FIG. 9 is a sectional view illustrating a configuration of a bidirectional connector including a magnetic material according to various embodiments of the present disclosure.

Referring to FIG. 9, description of a configuration, which a bidirectional connector 900 mounted to an electronic device according to various embodiments and the bidirectional connector 400 illustrated in FIG. 4 commonly have, will be omitted, and only a difference therebetween will be described.

The bidirectional connector 900 according to various embodiments has the same configuration as that of the bidirectional connector illustrated in FIG. 4, except for a material thereof, and thus, a detailed description thereof will be omitted.

An electronic device including the bidirectional connector 900 according to various embodiments may include a substrate 95, a first magnetic connector 91 mounted on the substrate 95 in a first direction, a second magnetic connector 92 mounted on the substrate 95 in a second direction opposite to the first direction, and a magnetic connection member 93 for connecting the first and second magnetic connectors 91 and 92 to each other.

The first magnetic connector 91 according to various embodiments may include a first conductive member 910, a first hollow connective member 912, a first elastic member 914, and a first insulation structure 940. The first connector 91 may be arranged on a first surface 950 of the substrate or may be arranged to stand upright in a perpendicular direction to the first surface 950.

The second connector 92 according to various embodiments may include a second conductive member 920, a second hollow member 922, a second elastic member 924, a multi-connection member 926, and a second insulation structure 942. The second connector 92 according to various embodiments may be arranged on a second surface 952 of the substrate or may be arranged to stand upright in a perpendicular direction to the second surface 952.

A first electric path according to various embodiments may include a first conductive member 910, a first elastic member 910 which may be in contact with the first conductive member 914, a connection member 93 which may always in contact with the first elastic member 914, and a multi-connection member 926 which may always be in contact with the connection member 93. The first electric path according to various embodiments can be formed within the substrate 95 so as to be connected to the connection member 93.

A second electric path according to various embodiments may include a second conductive member 920, a second elastic member 924 which may be in contact with the second conductive member 920, a multi-connection member 926 which may be in contact with the second elastic member 924, and a connection member 93 which may be in contact with the multi-connection member 926. The second electric path according to various embodiments can be formed within the substrate 95 so as to be connected to the second connector 92.

A connection member according to various embodiments may include a magnetic material. For example, the connection member may include both a conductive material and a magnetic material. The connection member may use an attractive force by a metal material or an attractive force or a repulsive force by a magnetic force.

The multi-connection member according to various embodiments may include a magnetic material. For example, the multi connection member has a first pole and the connection member has a second pole opposite to the first pole, thereby more stably providing a multi-contact point structure.

Figure 10:
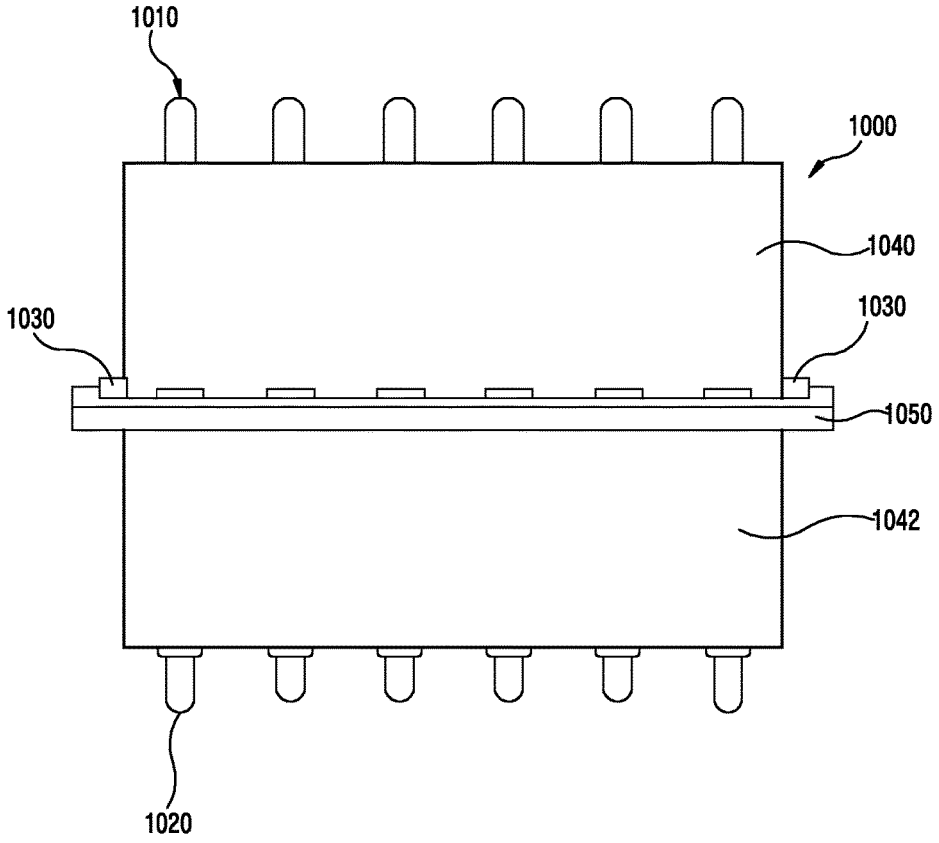
FIG. 10 is a front view of an exterior of the bidirectional connector array of FIG. 6.

FIG. 10 is a front view illustrating an outer appearance of the bidirectional connector array of FIG. 6. Referring to FIG. 10, a bidirectional connector 1000 mounted to an electronic device according to various embodiments includes a plurality of first connectors 1010 aligned on a first surface of a substrate 1050 and a plurality of second connectors 1020 aligned on a second surface of the substrate. Such first and second connectors 1010 and 1020 can be supported by first and second insulation structures 1040 and 1042. A part of the connection member 1030 can be fixed to the first surface of the substrate 1050.

Figures 11A, 11B, 11C:
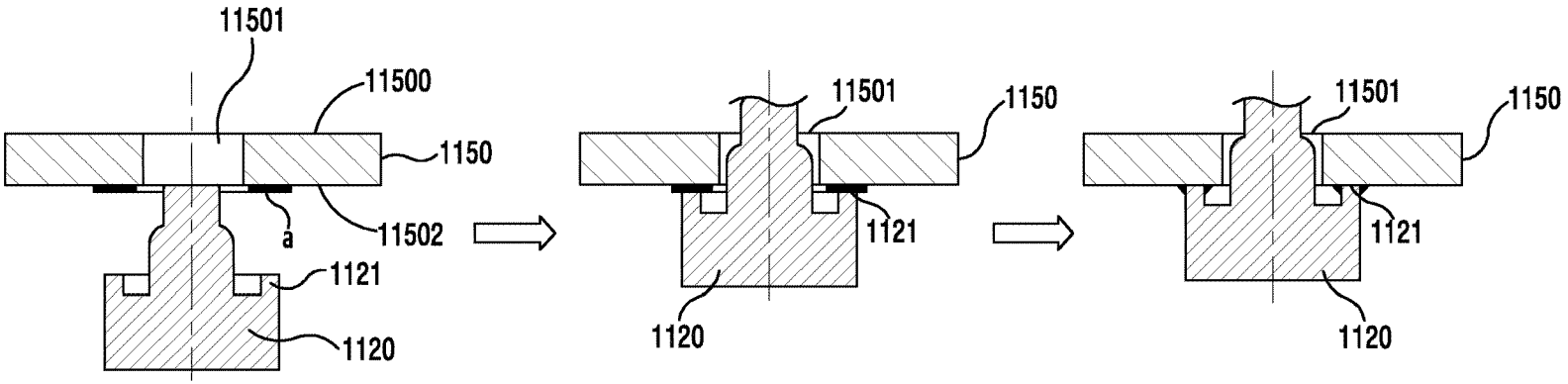
FIG. 11A, FIG. 11B and FIG. 11C sequentially illustrate a process in which a connector is soldered on a substrate according to various embodiments.

FIGS. 11A to 11C sequentially illustrate a process in which a connector may be soldered on a substrate according to various embodiments.

Referring to FIGS. 11A to 11C, a connector 1120 mounted to an electronic device according to various embodiments can be mounted to a substrate in the following scheme. A substrate 1150 may include a first surface 11500 and a second surface 11502 opposite to the first surface 11500. An opening 11501 through which the connector 1120 passes can be formed on the substrate 1150. A soldering region a can be arranged on the second surface 11502 of the substrate along a neighboring part of the opening 11501. The connector 1120 can be arranged through the opening 11501, and the connector 1120 can be fixed to the substrate 1150 through a soldering process of the neighboring part 1121 of the connector 1120.

Figure 12A:
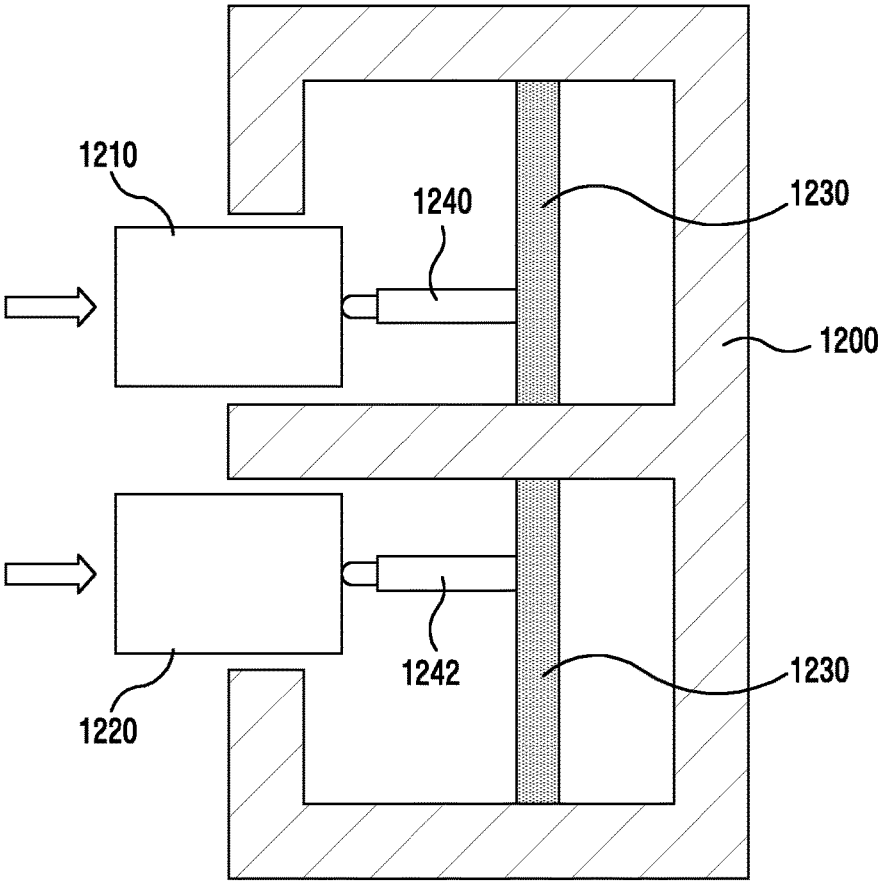
FIG. 12A schematically illustrates a state in which each electronic device is connected to two unidirectional connectors according to various embodiments.
Figure 12B:
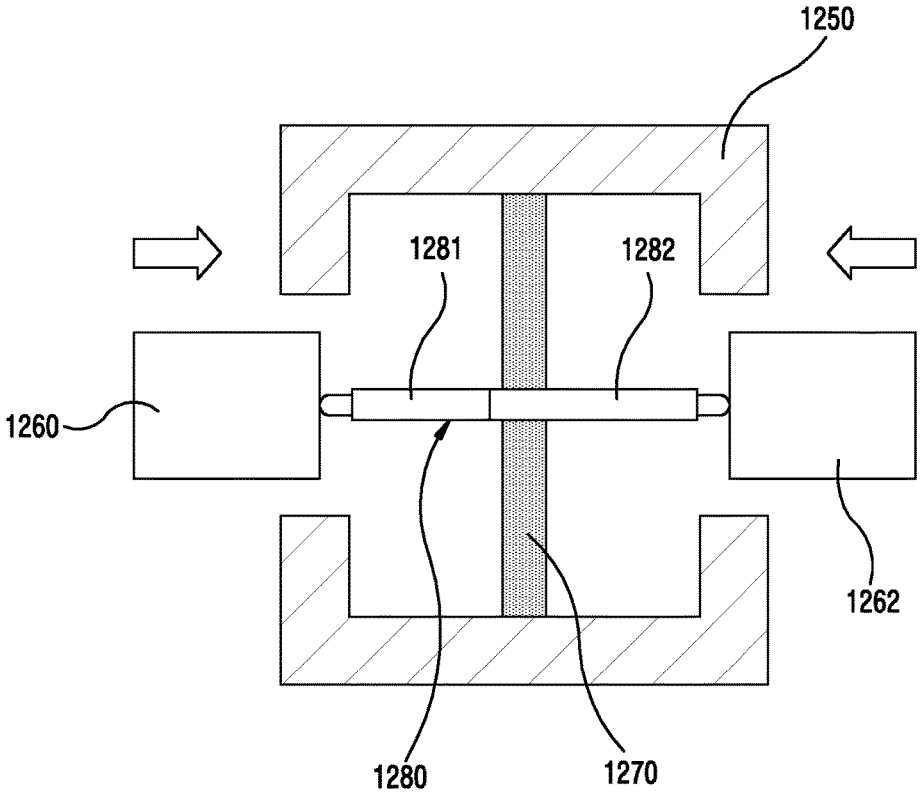
FIG. 12B schematically illustrates a state in which each electronic device is connected to a bidirectional connector according to various embodiments.

FIG. 12A schematically illustrates a state in which each electronic device may be connected to two unidirectional connectors according to various embodiments. FIG. 12B schematically illustrates a state in which each electronic device may be connected to a bidirectional connector according to various embodiments.

A mounting structure of a unidirectional connector and a bidirectional connector mounted to an electronic device according to various embodiments will be described with reference to FIGS. 12A and 12B.

Referring to FIG. 12A, first and second unidirectional connectors 1240 and 1242 are needed in order to electrically connect a pair of electronic devices 1210 and 1220 according to various embodiments to a substrate 1230. The first and second unidirectional connectors 1240 and 1242 can be arranged on a first surface of the substrate 1230 side by side.

A housing 1200 according to various embodiments may include a structure for receiving the substrate 1230 and the pair of electronic device 1210 and 1220. In the structure, one electronic device 1210 can be electrically connected to the first unidirectional connector 1240, and another electronic device 1220 can be electrically connected to the second unidirectional connector 1242.

Referring to FIG. 12B, a bidirectional connector 1280 may be adopted to electrically connect a pair of electronic devices 1260 and 1262 according to various embodiments to a substrate 1270. The bidirectional connector 1280 can be configured such that first and second connectors 1281 and 1282 stand upright on first and second surfaces of the substrate 1270.

A housing 1250 according to various embodiments may include a structure for receiving the substrate 1270 and the pair of electronic device 1260 and 1262. In the structure, one electronic device 1260 can be electrically connected to the first connector 1281 of the bidirectional connector, and another electronic device 1262 can be electrically connected to the second connector 1282 of the bidirectional connector.

In the substrate 1270 according to various embodiments, the first connector 1281 can be arranged to stand upright on the first surface, and the second connector 1282 can be arranged to stand upright on the second surface. The first and second connectors 1281 and 1282 can be replaced with each other.

The substrate 1230 illustrated in FIG. 12A has a structure in which the first and second unidirectional connectors 1240 and 1242 are arranged on the first surface side by side. Meanwhile, the substrate 1270 illustrated in FIG. 12B has a structure in which the bidirectional connector 1280 may be arranged using the first and second surfaces. When the sizes of the housings 1200 and 1250 of both cases are configured with each other, the latter housing 1250 can be configured to have a smaller size. In the electronic device according to various embodiments, the bidirectional connector 1280 may be mounted as a connector so that a design thereof can be changed variously.

In the electronic device having a bidirectional connector according to various embodiments of the present disclosure, the second surface as well as the first surface of the substrate may be used, thereby reducing costs of materials according to a decrease in the size of the substrate.

The electronic device having a bidirectional connector according to various embodiments of the present disclosure can provide differentiation of a design of an outer appearance.

In the electronic device having a bidirectional connector according to various embodiments, insertion types for connection can be various.

The electronic device having a bidirectional connector according to various embodiments of the present disclosure can make an electrical pattern of the substrate efficient.

The term "module," as used herein may represent, for example, a unit including a combination of one or two or more of hardware, software, or firmware. The "module" may be, for example, used interchangeably with the terms "unit", "logic", "logical block", "component", or "circuit" etc. The "module" may be the minimum unit of an integrally constructed component or a part thereof. The "module" may be also the minimum unit performing one or more functions or a part thereof. The "module" may be implemented mechanically or electronically. For example, the "module" may include at least one of an application-specific integrated circuit (ASIC) chip, Field-Programmable Gate Arrays (FPGAs) and a programmable-logic device performing some operations known to the art or to be developed in the future.

At least a part of an apparatus (e.g., modules or functions thereof) or method (e.g., operations) according to the present disclosure may be, for example, implemented as instructions stored in a computer-readable storage medium in a form of a programming module. In case that the instruction is executed by a processor (e.g., processor 120), and the processor may perform functions corresponding to the instructions. The computer-readable storage media may be the memory 130, for instance.

The computer-readable recording medium may include a hard disk, a floppy disk, and a magnetic medium (e.g., a magnetic tape), an optical medium (e.g., a Compact Disc-Read Only Memory (CD-ROM) and a Digital Versatile Disc (DVD)), a Magneto-Optical Medium (e.g., a floptical disk), and a hardware device (e.g., a Read Only Memory (ROM), a Random Access Memory (RAM), a flash memory, etc.). Also, the program instruction may include not only a mechanical language code such as a code made by a compiler but also a high-level language code executable by a computer using an interpreter, etc. The aforementioned hardware device may be constructed to operate as one or more software modules in order to perform operations of the present disclosure, and vice versa.

The module or programming module according to the present disclosure may include at least one or more of the aforementioned constituent elements, or omit some of the aforementioned constituent elements, or further include additional other constituent elements. Operations carried out by the module, the programming module or the other constituent elements according to the present disclosure may be executed in a sequential, parallel, repeated or heuristic method. Also, some operations may be executed in different order or may be omitted, or other operations may be added.

Accordingly, a method and electronic device are provided for controlling a display according to the present disclosure, to determine the priority of display based on a user's preference, thereby being able to decrease a search time for display and more quickly display a desired screen.

While the present disclosure has been shown and described with reference to certain embodiments thereof, it will be apparent to those skilled in the art that the camera lens module according to the present disclosure is not limited to these embodiments, and various changes in form and details may be made therein without departing from the spirit and scope of the present disclosure as defined by the appended claims.

What is claimed is:

1. An electronic device comprising:

a substrate including a first surface facing a first direction, and a second surface facing a second direction, the second direction being opposite to the first direction;

a first connector arranged on the first surface, wherein the first connector includes:

a first hollow member extending in the first direction;

a first movable conductive member inserted in the first hollow member and movable in the first direction; and a first elastic member for supporting the first movable conductive member;

a second connector arranged on the second surface and aligned with the first connector in the first direction, wherein the second connector includes a second hollow member extending in the first direction, a second movable conductive member inserted into the second hollow member and movable in the first direction, and a second elastic member for supporting the second movable conductive member, wherein the second connector is aligned in the first direction with the first connector; and wherein the substrate includes at least one electrical path, wherein the at least one electrical path provides electrical connection to at least one of the first movable conductive member and the second movable conductive member.

2. The electronic device of claim 1, further comprising:

a first insulation structure surrounding at least a part of the first hollow member and being arranged on the first surface of the substrate; and a second insulation structure surrounding at least a part of the second hollow member and being arranged on the second surface of the substrate.

3. An electronic device comprising:

a substrate including a first surface facing a first direction, and a second surface facing a second direction, the first direction being opposite to the second direction;

a plurality of first connectors positioned and aligned on the first surface, wherein each of the first connectors includes:

a first hollow member extending in the first direction;

a first movable conductive member inserted into the first hollow member and movable in the first direction; and a first elastic member, the first elastic member being configured to supporting the first movable conductive member; a plurality of second connectors positioned and aligned on the second surface, wherein each of the second connectors includes:

a second hollow member extending in the first direction;

a second movable conductive member inserted into the second hollow member and movable in the first direction; and a second elastic member for supporting the second movable conductive member, wherein at least one of the second connectors is aligned in the first direction with a respective one of the first connectors; and wherein the substrate includes a plurality of electrical paths, wherein the plurality of electrical paths including one path provides an electrical connection to a respective one of the first movable conductive members and/or a respective one of the second movable conductive members.

4. The electronic device of claim 3, further comprising:

a first insulation structure surrounding at least a part of the first hollow members and being arranged on the first surface of the substrate; and a second insulation structure surrounding at least a part of the second hollow members of the second connectors and being arranged on the second surface of the substrate.

5. An electronic device comprising:

a substrate including a first surface and a second surface facing in an opposite direction relative to the first surface;

at least one first connector arranged on the first surface to elastically support a first conductive member;

at least one second connector arranged on the first connector to elastically support a second conductive member; and at least one connection member arranged on the first surface, to which at least a part of the second connector is connected, wherein an electrical connection path is provided between the first and second conductive members using the connection member, wherein at least a part of the second connector includes a multi-connection member, and wherein the multi-connection member includes a magnetic material.

6. The electronic device of claim 5, wherein the connection member is press-fitted in a part of the first connector.

7. The electronic device of claim 6, wherein the connection member comprises:

a press-fitted part press-fitted to the first connector; and a non-press-fitted part exposed to the first connector, wherein the non-press-fitted part is fixed to the substrate.

8. The electronic device of claim 7, wherein the multi-connection member has a convex shape and has elasticity, and the multi-connection member provides a multi-contact-point structure in which the multi-connection member is connected to the inner surface of the press-fitted part at a plurality of points.

9. The electronic device of claim 7, wherein the multi-connection member is arranged within the first connector.

10. The electronic device of claim 7, wherein the multi-connection member is arranged in the press-fitted part.

11. The electronic device of claim 5, wherein the first and second connectors each includes a magnetic material.

12. The electronic device of claim 8, wherein each of the first and second conductive materials and each of the connection members includes a magnetic material.

13. The electronic device of claim 5, wherein the plurality of first connectors are arranged on the first surface of the substrate side by side and supported by a first insulation structure, the plurality of second connectors are arranged on the second surface of the substrate side by side and supported by a second insulation structure.

14. An electronic device comprising:

a substrate including a first surface and a second surface facing an opposite direction relative to the first surface;

a first connector array configured by aligning and arranging, on the first surface of the substrate, a plurality of first connectors arranged to elastically support a first conductive member;

a second connector array configured by aligning and arranging, on the second surface of the substrate, a plurality of second connectors arranged to elastically support a second conductive member; and a plurality of connection members arranged on the first surface, press-fitted in at least a part of the first connectors, and connected to at least a part of the second connectors, respectively, wherein at least one electrical connection path is provided between the first connectors and the second connectors using the connection members, respectively, wherein at least a part of the second connector includes a multi-connection member, and wherein the multi-connection member includes a magnetic material.

15. The electronic device of claim 14, wherein each of the connection members comprises:

a press-fitted part having a first inner diameter and is press-fitted in a respective one of the first connectors; and a non-press-fitted part having a second inner diameter larger than the first inner diameter, is not press-fitted in the respective one of the first connectors, and is exposed.

16. The electronic device of claim 15, wherein the second connectors are arranged to vertically pass through the substrate, and each of the second connectors has one end arranged on the first surface so that at least a part of the second connectors is connected to the press-fitted part, and the other part of each of the second connectors is arranged on the second surface.

17. The electronic device of claim 14, wherein each of the first and second connectors has a cylindrical shape.

18. The electronic device of claim 14, wherein the first connectors are arranged to have a repeated arrangement and the second connectors are arranged to have a repeated arrangement.

* * * * *